US011372346B2

(12) United States Patent
Lee et al.

(10) Patent No.: US 11,372,346 B2
(45) Date of Patent: Jun. 28, 2022

(54) DEVELOPING CARTRIDGE HAVING A HEAT TRANSFER BLOCKING MEMBER

(71) Applicant: Hewlett-Packard Development Company, L.P., Spring, TX (US)

(72) Inventors: Ho-Ryul Lee, Pangyo (KR); Yoshihiko Ichikawa, Pangyo (KR); Ji-Won Moon, Pangyo (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/299,135

(22) PCT Filed: Feb. 3, 2020

(86) PCT No.: PCT/US2020/016350
§ 371 (c)(1),
(2) Date: Jun. 2, 2021

(87) PCT Pub. No.: WO2020/180439
PCT Pub. Date: Sep. 10, 2020

(65) Prior Publication Data

US 2022/0075287 A1 Mar. 10, 2022

(30) Foreign Application Priority Data

Mar. 7, 2019 (KR) ..... 10-2019-0026441

(51) Int. Cl.
*G03G 21/20* (2006.01)
*G03G 15/08* (2006.01)

(52) U.S. Cl.
CPC ..... *G03G 15/0865* (2013.01); *G03G 21/20* (2013.01)

(58) Field of Classification Search
CPC ..... G03G 15/0865; G03G 21/20
See application file for complete search history.

(56) References Cited

U.S. PATENT DOCUMENTS 4,951,070 A * 8/1990 Theodoulou ..... G03G 15/321 346/139 C
4,958,172 A * 9/1990 McCallum ..... G03G 15/323 347/125
5,239,349 A * 8/1993 Hoover ..... G03G 21/1685 399/323
5,315,324 A * 5/1994 Kubelik ..... B41J 2/415 347/120
6,141,512 A * 10/2000 Nagano ..... G03G 21/1814 399/92

(Continued)

FOREIGN PATENT DOCUMENTS

JP JPS60179768 A 9/1985
JP H06186794 A * 12/1992

(Continued)

*Primary Examiner* — David J Bolduc
(74) *Attorney, Agent, or Firm* — Jefferson IP Law, LLP

(57) ABSTRACT

An image forming apparatus includes a body, a development cartridge to be attached to or detached from the body, and a fixing device to fix toner to a recording medium. The development cartridge includes a heat transfer blocking member disposed on an outer side of the development cartridge and adjacent to the fixing device when the development cartridge is attached to the body.

15 Claims, 7 Drawing Sheets

(56) References Cited

U.S. PATENT DOCUMENTS

2001/0055498 A1* 12/2001 Matsuzaki ..... G03G 21/185 399/111
2004/0234291 A1* 11/2004 Likawa ..... G03G 21/206 399/92
2006/0245787 A1* 11/2006 Ito ..... G03G 21/20 399/353
2007/0274743 A1* 11/2007 Tamura ..... G03G 15/0874 399/258
2010/0067929 A1* 3/2010 Seki ..... G03G 15/2042 399/45
2012/0107009 A1* 5/2012 Yano ..... G03G 21/206 399/92
2014/0079455 A1* 3/2014 Seki ..... G03G 15/2017 399/329
2014/0140719 A1* 5/2014 Suzuki ..... G03G 15/0189 399/92
2014/0341623 A1* 11/2014 Arai ..... G03G 15/2053 399/329
2015/0185689 A1* 7/2015 Tanaka ..... G03G 21/206 399/92
2018/0101133 A1* 4/2018 Oya ..... G03G 15/2017
2019/0196396 A1* 6/2019 Ueda ..... G03G 21/20
2020/0340522 A1* 10/2020 Muneda ..... F16C 17/243

FOREIGN PATENT DOCUMENTS

JP 1994236083 8/1994
JP 1995175376 7/1995
JP 2000275975 10/2000
JP 2006313294 11/2006
JP 2009069318 4/2009
WO WO2005067440 A2 7/2005
WO WO2012147988 A1 11/2012
WO WO2014069263 A1 5/2014

* cited by examiner

DEVELOPING CARTRIDGE HAVING A HEAT TRANSFER BLOCKING MEMBER

BACKGROUND

An image forming apparatus is an apparatus for forming an image on paper according to an input signal. Representative examples of the apparatus include a printer, a copy machine, a facsimile, a multifunction peripheral (MFP) that integrally implements these functions.

An electrophotographic image forming apparatus, which is a kind of an image forming apparatus, forms an electrostatic latent image on the surface of a photosensitive drum by irradiating modulated light onto the photosensitive drum corresponding to image information, supplies toner to the electrostatic latent image to develop a visible toner image, and transfers and fixes the toner image onto paper, thereby printing an image on the paper.

DETAILED DESCRIPTION

Hereinafter, various examples of the disclosure will be described in detail with reference to the accompanying drawings. The examples to be described below may also be modified in various forms. In order to more clearly describe features of the examples, a detailed description of matters which are well known to those to skilled in the art to which the examples pertain will be omitted.

Meanwhile, in the specification, a case in Which any component is "connected" with another component includes a case in which any component is 'directly connected' to another component and a case in which any component is 'connected to another component while having the other component interposed therebetween'. In addition, a case in which any component "comprises" another component means that any component may further comprise other components, not exclude other components, unless explicitly described to the contrary.

In addition, an "image forming apparatus" refers to a device for printing print data generated from a terminal such as a computer on a recoding medium. The recording medium may include, for example, paper such as glossy paper, plain paper, art paper, overhead projector film, cardstock, and the like. Examples of the image forming apparatus described above may include a copier, a printer, a facsimile, a multifunction printer (MFP) of complexly implementing functions thereof through a single device, and the like. The image forming apparatus may mean all devices capable of performing an image forming task, such as the printer, the scanner, the fax machine, the multi-function printer (MFP), or a display.

The disclosure is not limited to an example disclosed below and may be implemented in various forms and the scope of the disclosure is not limited to the following examples. In addition, all changes or modifications derived from the meaning and scope of the claims and their equivalents should be construed as being included within the scope of the disclosure. In the following description, the configuration which is publicly known but irrelevant to the gist of the disclosure could be omitted. In addition, the attached drawings are not drawn to scale to facilitate understanding of the disclosure, but the dimensions of some of the components may be exaggerated.

An example of the recording medium, paper, is used throughout the specification below as an example. However, even though the term "paper" is used, different types of recording medium may be substituted for paper in the description below and the examples below are not necessarily limited to paper.

Figure 1:
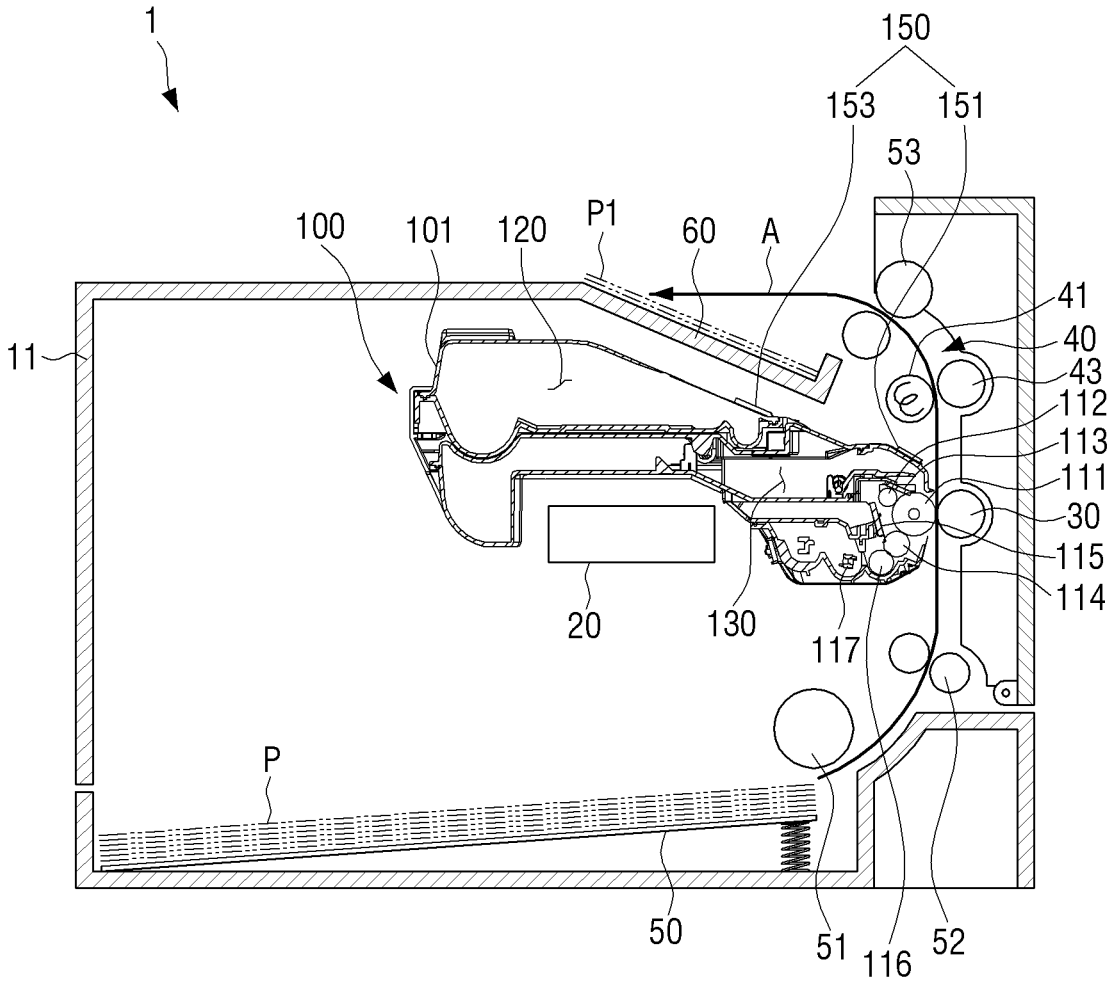
FIG. 1 is a schematic configuration view illustrating an image forming system according to an example.

FIG. 1 is a schematic configuration view illustrating an image forming system according to an example.

Referring to FIG. 1, an image forming apparatus 1 according to an example of the disclosure includes an exposure device 20 in a body 11, a development cartridge 100, a transfer roller 30, and a fixing device 40 for fixing paper[SK1].

The body 11 may form the outside of the image forming apparatus 1, and support various components mounted therein. The body 11 may include a path in which the development cartridge 100 is mounted or detached.

The exposure device 20 may form an electrostatic latent image on the photosensitive drum 111 by irradiating the photosensitive drum 111 with light including image information.

The development cartridge 100 may be an assembly of components for forming a visible image, which may be attached to or detached from the inside of the body 11. It may be a consumable product that is replaced when the life span has passed. The development cartridge 100 may accommodate a developer therein, and develop an electrostatic latent image into a visible image by supplying a developer (e.g., toner) to the electrostatic latent image. The development cartridge 100 may be referred to as a toner cartridge.

The development cartridge 100 may include a plurality of development cartridges. For example, for color printing, the image forming apparatus may include 4 (four) development cartridges 100.

The development cartridge 100 may include a housing 101 which forms the outer appearance of the development cartridge 100 and a photosensitive drum 111, a charging roller 112, a cleaning member 113, a development roller 114, a regulating member 115, a supply roller 116, and an agitator 117, which are disposed inside the housing 101.

In addition, a toner accommodation part 120 and a waste toner accommodation part 130 may be provided in the housing 101 of the development cartridge 100. The waste toner accommodation part 130 may store waste toner scraped from the outer circumferential surface of the photosensitive drum 111 by the cleaning member 113. The toner accommodation part 120 may store toner, which is a developer. The toner accommodation part 120 may supply toner to the supply roller 116. The waste toner accommodation part 130 may be disposed below the gravity direction of the toner accommodation part 120.

When the development cartridge 100 is mounted on the body 11, the toner accommodation part 120 may be disposed under the paper discharge tray 60, and the waste toner accommodation part 130 may be disposed under the fixing device 40.

The development cartridge 100 may be replaced by a new one when the toner accommodated in the toner accommodation part 120 is all consumed.

The photosensitive drum 111 may be an example of a photoconductor in which an electrostatic latent image is formed, and a photosensitive layer having a light conductivity may be formed on the outer circumference of a cylindrical metal pipe. The charging roller 112 may be an example of a charging device that charges the surface of the photosensitive drum 111 to a uniform potential. The photosensitive drum 111 may be charged to a predetermined potential through the charging roller 112, and an electrostatic latent image corresponding to an image to be printed by light irradiated from the exposure device 20 may be formed on the outer circumferential surface. The development roller 114 may be configured to supply toner to the electrostatic latent image formed on the surface of the photosensitive drum 111 for development.

The toner accommodated in the toner accommodation part 120 may be transmitted to the supply roller 116 through a slit (not shown) disposed under the toner accommodation part 120. The toner accommodation part 120 for storing toner, the supply roller 116 for supplying a toner to the photosensitive drum 111, and the development roller 114 may be formed to be connected to each other.

The supply roller 116 may supply a toner to the development roller 114, and the agitator 117 may shake a toner supplied from the toner accommodation part 120 not to be hardened. The regulating member 115 may regulate the thickness of the toner supplied from the supply roller 116, and attached to the outer circumferential surface of the development roller 114.

The cleaning member 113 may remove waste toner that is not transferred to the paper P, but remains on the surface of the photosensitive drum 111, and the waste toner removed by the cleaning member 113 may be accommodated on the waste toner accommodation part 130.

It has been described that the waste toner accommodation part 130 is disposed between the toner accommodation part 120, the development roller 114, the supply roller 116, the photosensitive drum 111, and the charging roller 112 in the development cartridge 100. However, the disclosure is not limited thereto, but the toner accommodation part 120, the development roller 114, the supply roller 116, the photosensitive drum 111, and the charging roller 112 may be disposed to be adjacent to one another.

The transfer roller 30 may be mounted to face the outer circumferential surface of the photosensitive drum 111. The toner image developed on the outer circumferential surface of the photosensitive drum 111 may be transferred to the paper P passing between the transfer roller 30 and the photosensitive drum 111 by the contact pressure between the transfer-vias or the photosensitive drum 111 and the transfer roller 30.

The fixing device 40 may apply heat and pressure to a toner image and fix the toner image to the paper P to form a permanent print image. The fixing device 40 may include a heat roller 41 for applying heat to the paper P to which the toner image is transferred, and a pressure roller 43 elastically attached to the heat roller 41. When the paper P to which the toner image is transferred passes between the heat roller 41 and the pressure roller 43, the toner image may be fixed to the paper P by heat and pressure.

The image forming apparatus 1 may include a paper feed tray 50 under the body 11, and a pick-up roller 51 for picking up the paper P loaded in the paper feed tray 50 piece by piece, and a paper feed roller 52 for providing a feed force to the picked up paper P, feeding the paper P between the photosensitive drum 111 and the transfer roller 30, and aligning the paper P to transfer an image on a portion of the paper P. The image forming apparatus 1 may include a paper discharge roller 53 for discharging paper P1 passed through the fixing device 40 and on which a predetermined image is printed to the paper discharge tray 60 of the outside of the body 11.

The printing process of the image forming apparatus 1 will be described briefly. The photosensitive drum 111 may be charged to a predetermined potential through the charging roller 112, and an electrostatic latent image may be formed corresponding to the image to be printed on the outer circumferential surface in response to the scanned light. The toner in the toner accommodation part 120 of the development cartridge 100 may be supplied the space where the supply roller 116 is disposed, and the supplied toner may be agitated by the agitator 117, and supplied to the photosensitive drum 111 in which an electrostatic latent image is formed through the supply roller 116 and the development roller 114 to develop a visible image on the outer circumferential surface of the photosensitive drum 111.

The paper P may move along a movement path A. The paper P loaded at the top of the paper feed tray 50 may be picked up by the pick-up roller 51, and fed and aligned by the paper feed roller 52 to pass between the photosensitive drum 111 and the transfer roller 30. The toner image developed on the outer circumferential surface of the photosensitive drum 111 may be transferred to a surface opposite to the photosensitive drum 111 of the paper P. The toner image transferred to the paper P may pass through the fixing device 40 to be fixed onto the paper P by heat pressure, and conveyed by the paper charge roller 53 to be loaded in the paper discharge tray 60.

The image forming apparatus 1 of the electrophotographic method may have the fixing device 40 for fixing the toner image on the surface of the paper P by applying heat and pressure to the paper P to which the toner image is transferred unlike an inkjet image forming apparatus.

The heat roller 41 of the fixing device 40 may include a heat source such as a lamp or a heat conductor that generates high heat, and the pressure roller 43 may have an outer surface formed of an elastic layer and be attached to the heat roller 41 to rotate together with the heat roller 41.

Referring to FIG. 1, the fixing device 40 of the image forming apparatus may be mounted at the upstream of the paper discharge tray 60 through which printed paper P1 is discharged, and the paper discharge roller 53 that guides the paper P1 passed between the heat roller 41 and the pressure roller 43 to the paper charge tray 60 may be mounted at the downstream of the fixing device 40.

When printing is executed in the image forming apparatus 1, the heat roller 41 may heat and the heat roller 41 and the pressure roller 43 may rotate. The paper P passing between the heat roller 41 and the pressure roller 43 may receive heat and pressure, and then the toner image transferred thereon may be fixed to the surface of the paper P.

When the heat roller 41 is operated, the heat of the heat roller 41 may be transmitted to the periphery of the heat roller 41 by way of conduction, convection, radiation, etc., and may heat ambient air. Thereby, the pressing roller 43 may be heated by radiant heat from the heat roller 41.

In this case, heat generated from the heat roller 41 of the fixing device 40 may be transferred to the fixing device 40 and adjacent components by radiation, conduction, and convection. For example, the temperature of the development cartridge 100 disposed around the fixing device 40 may be raised by the heat transferred from the fixing device 40.

Papers P1 that have passed through the fixing device 40 may receive heat from the fixing device 40 and be loaded on the paper discharge tray 60 in a high temperature state. The paper discharge tray 60 may be raised in temperature by the heat transmitted from the loaded papers P1. Accordingly, the heat transferred to the paper discharge tray 60 may be transferred to the paper discharge tray 60 and adjacent components by radiation, conduction, and convection. For example, the development cartridge 100 disposed adjacent to the lower side of the paper discharge tray 60 may be raised in temperature by the heat transmitted from the paper discharge tray 60.

When the temperature of the development cartridge 100 is raised by the fixing device 40 or the paper discharge tray 60, the operation of the image forming apparatus 1 may be unstable due to the solidification of toner or waste toner stored therein.

The development cartridge 100 may further include a heat transfer blocking member 150 for blocking heat transmitted from the fixing device 40 or the paper discharge tray 60.

When the development cartridge 100 is mounted on the body 11, the heat transfer blocking member 150 may be disposed at the outer side adjacent to the fixing device 40. The heat transfer blocking member 150 may include a first heat blocking plate 151 disposed in an area corresponding to the fixing device 40 of the outer side of the development cartridge 100, and a second heat blocking plate 153 disposed in an area corresponding to the paper charge tray 60 of the outer side of the development cartridge 100. The detailed structure and shape of the heat transfer blocking member 150 will be described below.

The first heat blocking plate 151 may prevent the temperature rise of the waste toner accommodation part 130, and the solidification of the waste toner stored in the waste toner accommodation part 130 to easily discharge the waste toner. The second heat blocking plate 153 may prevent the temperature rise of the toner accommodation part 120 so that the solidification of the toner may be prevented. Accordingly, the image forming apparatus 1 may lower the temperature of the development cartridge 100 to a predetermined level or less to ensure the printing quality of and the productivity.

Figure 2:
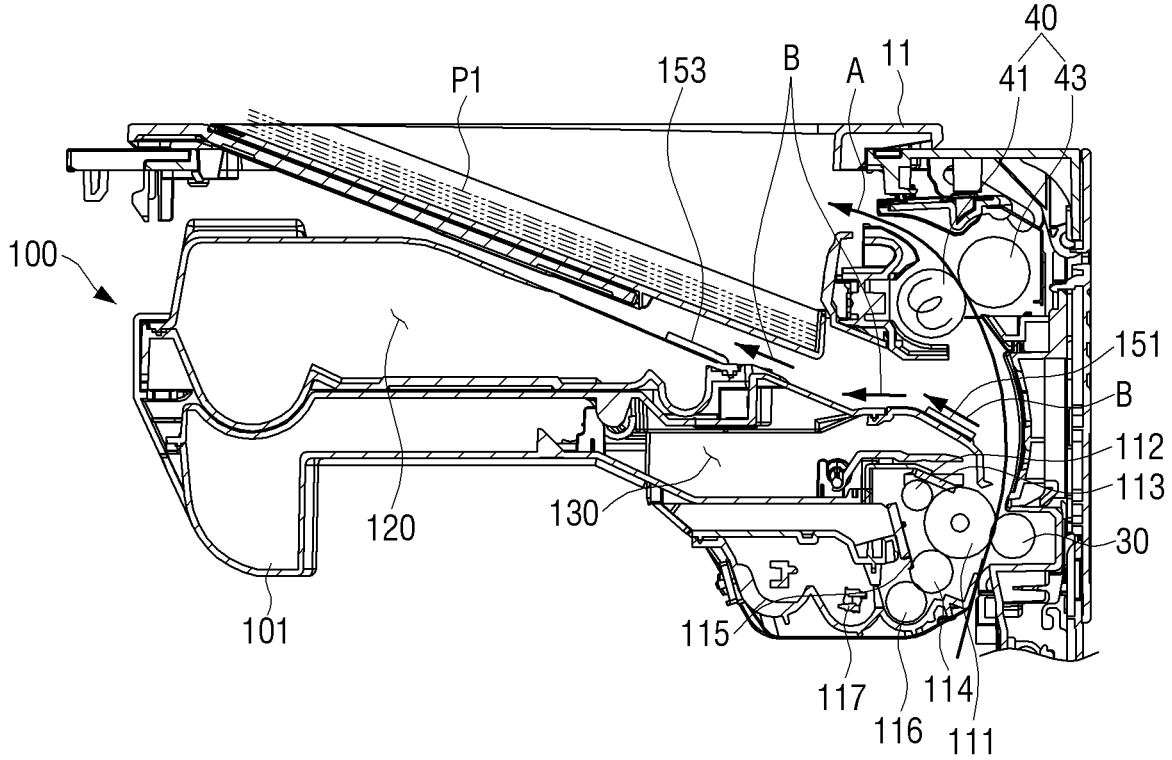
FIG. 2 is an enlarged view illustrating a development cartridge and a fixing device of FIG. 1.

FIG. 2 is an enlarged view illustrating a development cartridge and a fixing device of FIG. 1.

Referring to FIG. 2, the heat transfer blocking member 150 may include a plurality of heat transfer blocking members. The heat transfer blocking member 150 may include the first heat blocking plate 151 disposed on the outer side of the waste toner accommodation part 130, and the second heat blocking plate 153 disposed on the outer side of the waste toner accommodation part 120.

The first heat blocking plate 151 may be disposed above the waste accommodation part 130 opposite to the lower surface of the fixing device 40. The first heat blocking plate 151 may be disposed on the outer side adjacent to the fixing device 40 to prevent radiant heat and convection heat generated from the fixing device 40. Accordingly, the first heat blocking plate 151 may prevent the solidification of the waste toner stored in the waste toner accommodation part 130.

FIG. 2 illustrates that the first heat blocking plate 151 is disposed above the waste toner accommodation part 130, but is not limited thereto. The first heat blocking plate 151 may be disposed on the side of the waste toner accommodation part 130 that forms a movement path A of paper.

The second heat blocking plate 153 may be disposed above the toner accommodation part 120 opposite to the lower surface of the paper discharge tray 60. The second heat blocking plate 153 may be disposed at the outer side adjacent to the paper discharge tray 60 to reflect and block radiant heat from the paper discharge tray 60. Accordingly, the second heat blocking plate 153 may prevent the solidification of the toner stored in the toner accommodation part 120.

The second heat blocking plate 153 may absorb convection heat of the paper discharge tray 60 and the fixing device 40 that is conveyed along the air flow due to the convection heat conveyance of the surface to reduce the temperature of the toner accommodation part 120.

The heat transfer blocking member 150 may be disposed in a position where the heat stability of the image forming apparatus 1 is necessary to prevent the temperature rise.

The space between the fixing device 40 and the development cartridge 100 may be narrowed by the heat transfer blocking member 150 to miniaturize the image forming apparatus 1.

The paper P loaded in the paper feed tray 50 during the printing process of the image forming apparatus 1 may pass between the photosensitive drum 111 and the transfer roller 30, and pass through the fixing device 40 to be loaded in the paper discharge tray 60 in a printed state.

According to the movement of the paper P, the flow path B flowing along the upper side surface of the development cartridge 100 may be formed in the image forming apparatus 1. The flow path B formed in the image forming apparatus 1 may be formed along the upper areas of the waste toner accommodation part 130 and the toner accommodation part 120 sequentially. Accordingly, air may arise from the waste toner accommodation part 130 toward the toner accommodation part 120.

The flow path B may be generated by the movement of the paper P, but may also be generated by the rotation of the driving component of the image forming apparatus 1.

Heat generated by the paper P loaded in the fixing device 40 or the paper discharge tray 60 may be transmitted to the periphery of the fixing device 40 by the air that flows along the flow path B.

The heat transfer blocking member 150 may be disposed along the flow path B. The flow path B connected from the upper portion of the first heat blocking plate 151 to the outside of the body 11 may be formed through the upper portion of the second heat blocking plate 153.

Air flowing along the flow path B may pass through the upper portion of the first heat blocking plate 151 and the upper portion of the second heat blocking plate 153, and it may cool the convection heat transmitted along the flow path B, and allows the movement of the air in the direction of the flow path (B), so that the heat may be effectively dissipated.

The heat transfer blocking member 150 may be formed to have a reflection coefficient of a predetermined value or more to reflect radiant heat. The heat transfer blocking member 150 may be formed to absorb the convection heat transmitted along the flow path B and to have a thermal conductivity coefficient higher than a predetermined value to transmit conductive heat to the surroundings.

The heat transfer blocking member 150 may have a reflection coefficient of 0.75 or more. The heat transfer blocking member 150 may have a thermal conductivity coefficient of 200 W/mK or more.

For example, the heat transfer blocking member 150 may be formed of an aluminum alloy tape, an aluminum alloy plate, or the like. Aluminum alloys have high reflection coefficients and high thermal conductivity coefficients, which could be effective for heat dissipation.

Figure 3:
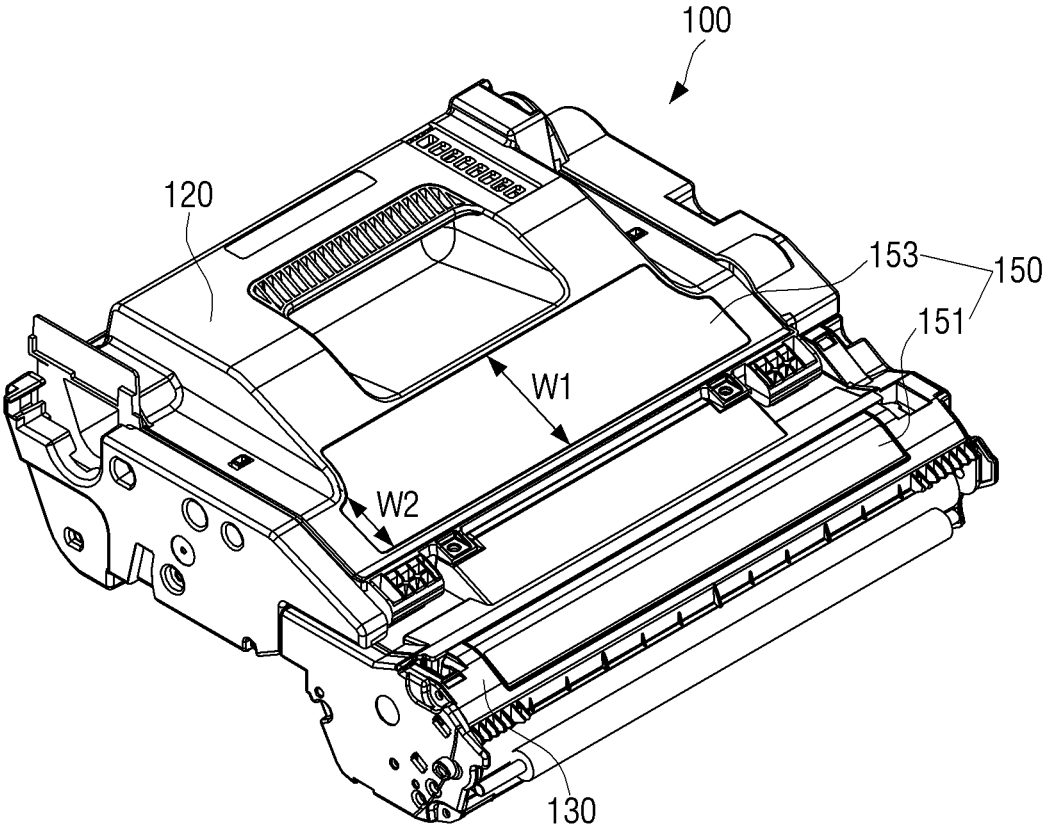
FIG. 3 is a perspective view illustrating a development cartridge according to an example.

FIG. 3 is a perspective view illustrating a development cartridge according to an example.

Referring to FIG. 3, the heat transfer blocking member 150 may extend in an axis direction of the development cartridge 100.

In a printing job, based on the axis direction, the temperature of the center of the development cartridge 100 may be higher than the temperature of the side. The side of the development cartridge 100 may be adjacent to the body 11 to easily emit heat, but the center of the development cartridge 100 may not easily emit heat than the side. Therefore, in order to lower the temperature of the center of the development cartridge 100, the area of the center of the heat transfer blocking member 150 may be formed to be larger than the area of the side.

A width W1 of the center of the first heat blocking plate 151 may be larger than a width W2 of the side. FIG. 2 illustrates that the second heat blocking plate 153 has a predetermined width, but is not limited thereto. The width of the center of the second heat blocking plate 153 may be larger than the width of the side.

The heat transfer blocking member 150 may ensure the heat stability of the center of the development cartridge 100 by having the large area of the center, where heat is concentrated. In addition, the heat transfer blocking member 150 may transfer the heat concentrated at the center of the development cartridge 100 to the left and right by a heat conductivity phenomenon to lower the temperature of the center.

The heat transfer blocking member 150 may be disposed so that air flow rising along the flow path B formed on the upper surface of the development cartridge 100 is not disturbed.

The heat transfer blocking member 150 may be closely attached to the housing 101 of the development cartridge 100, so that the space between the development cartridge 100 and the heat transfer blocking member 150 may not occur. Accordingly, air may not exist between the development cartridge 100 and the heat transfer blocking member 150, thereby preventing the rise of the temperature of the development cartridge 100 by uncirculated air.

The heat transfer blocking member 150 may be attached to the housing 101 of the development cartridge 100 using a double sided tape, and fixed by a screw. However, the disclosure is not limited thereto. The heat transfer blocking member 150 may be combined in various ways to be closely attached to the housing 101.

Figure 4:
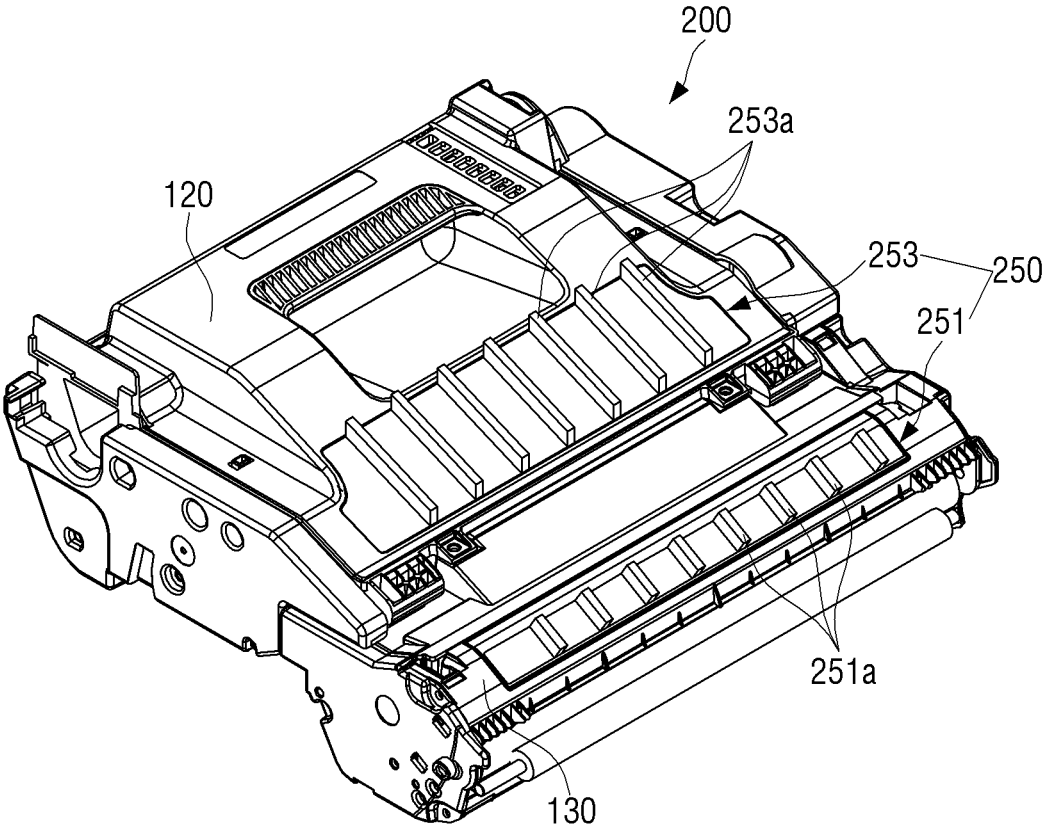
FIG. 4 is a perspective view illustrating a development cartridge according to another example.

FIG. 4 is a perspective view illustrating a development cartridge according to another example.

Referring to FIG. 4, a development cartridge 200 according to another example is the same as the development cartridge 100 of FIG. 2 mostly in terms of configuration. However, the shape of the heat transfer blocking member 250 may be different. Therefore, the detailed description of the development cartridge 200 according to another example, which is repeated description of the development cartridge 100 of FIG. 3 will be omitted.

The development cartridge 200 may include a heat transfer blocking member 250 disposed at the outer side adjacent to the fixing device 40 when mounted on the body 11.

The heat transfer blocking member 250 may include a plurality of protrusions 251*a* and 253*a* that protrude to improve heat dissipation efficiency. The first heat blocking plate 251 may include a plurality of protrusions 251*a* protruding in a direction of the fixing device 40, and the second heat blocking plate 253 may include a plurality of protrusions 253*a* protruding in a direction of the paper discharge tray 60.

The plurality of protrusions 251*a* and 253*a* may be spaced apart from one another in the axis direction of the development cartridge 200. In addition, the plurality of protrusions 251*a* and 253*a* may extend along the direction of the flow path B at a predetermined interval. The plurality of protrusions 251*a* and 253*a* may be provided so that air pass the protrusions adjacent to one another.

The plurality of protrusions 251*a* and 253*a* may protrude along the direction of air flow, and the heat dissipation area may become larger. Thus, the heat dissipated through the heat transfer blocking member 150 may be dissipated more effectively.

The plurality of protrusions 251*a* and 253*a* of the heat transfer blocking member 150 may be provided by forming a concave and convex in the mold and attaching aluminum alloy thereon, or by bending an aluminum alloy plate.

FIG. 4 illustrates that the cross-section of the heat transfer blocking member 150 including the plurality of protrusions 251*a* and 253*a* is a square, but is not limited thereto. The shape could be any one of a V shape, a U shape, and a trapezoid-type.

Figure 5:
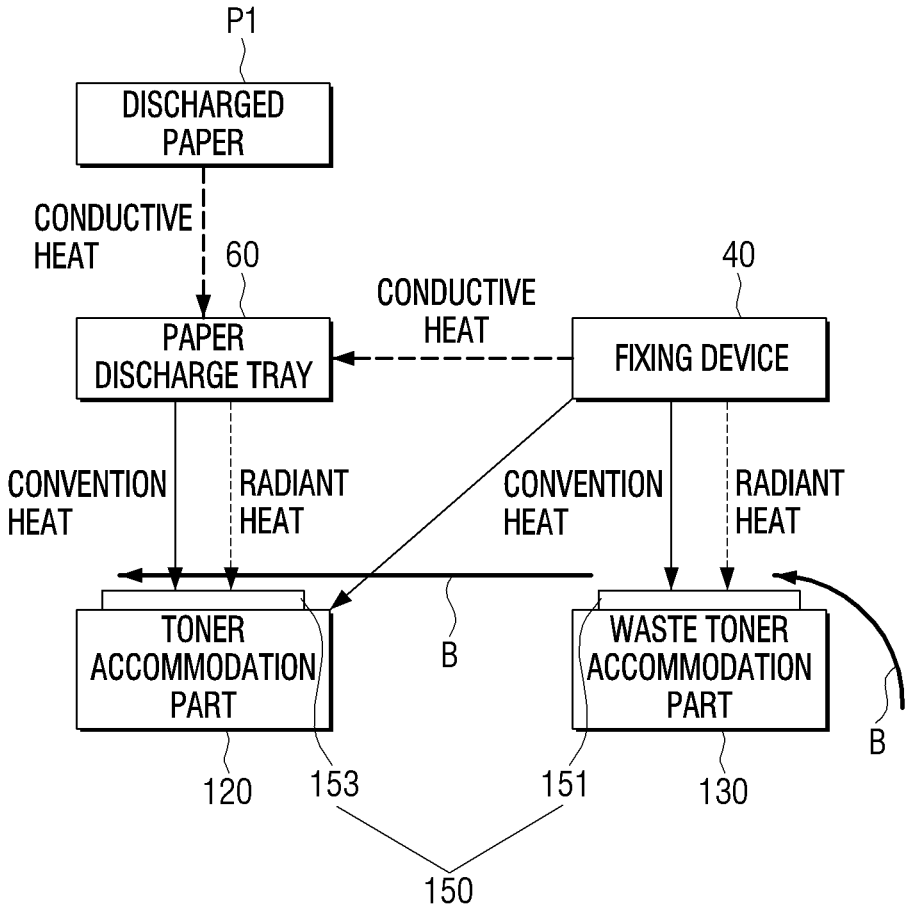
FIG. 5 is a block diagram to explain a heat flow of an image forming apparatus according to an example.

FIG. 5 is a block diagram to explain a heat flow of an image forming apparatus according to an example.

Referring to FIG. 5, the main heat source of the temperature rise of the image forming apparatus 1 may be the fixing device 40 and the discharged paper P1. The main cause of the temperature rise of the waste toner accommodation part 130 of the development cartridge 100 may be the fixing device 40, and the main cause of the temperature rise of the toner accommodation part 120 may be the discharged paper P1. The type of heat transfer from the main heat source to the development cartridge 100 may be radiation, convection, and conduction.

The heat flow of the image forming apparatus 1 will be described in detail.

The discharged paper P1 in a high temperature passing through the fixing device 40 may be loaded in the paper discharge tray 60. The temperature of the paper discharge tray 60 may rise due to the conductive heat transmitted from the loaded discharged paper P1. The paper discharge tray 60 with the raised temperature may emit radiant heat to the toner accommodation part 120 of the development cartridge 100, and transfer convection heat.

The fixing device 40 may emit radiant heat to the waste toner accommodation part 130 of the development cartridge 100 and transmit the convection heat to the waste toner accommodation part 130 and the toner accommodation part 120. Further, the fixing device 40 may transmit the conductive heat to the paper discharge tray 60 arranged to be in contact with it.

The first heat blocking plate 151 disposed on the outer side surface of the waste toner accommodation part 130 and the second heat blocking plate 153 disposed on the outer side surface of the toner accommodation part 120 may cool air moving along the flow path B formed by the movement of paper. The flow path B may be formed so that air may pass through the first heat blocking plate 151 and the second heat blocking plate 153 sequentially.

The heat transferred from the fixing device 40 and the paper discharge tray 60 may be reflected, or absorbed by the first heat blocking plate 151 and the second heat blocking plate 153, or discharged to the outside of the body 11, moving along the flow path B.

The first heat blocking plate 151 may reflect or absorb the radiant heat of the fixing device 40, reflect or absorb the convection heat of the fixing device 40 transferred according to the air flow to lower the temperature rise of the waste toner accommodation part 130.

The second heat blocking plate 153 may reflect or absorb the radiant heat of the paper discharge tray 60, or reflect or absorb the convection heat of the paper discharge tray 60 and the fixing device 40, which is transferred along the air flow to prevent the temperature rise of the waste toner accommodation part 130.

Figure 6A:
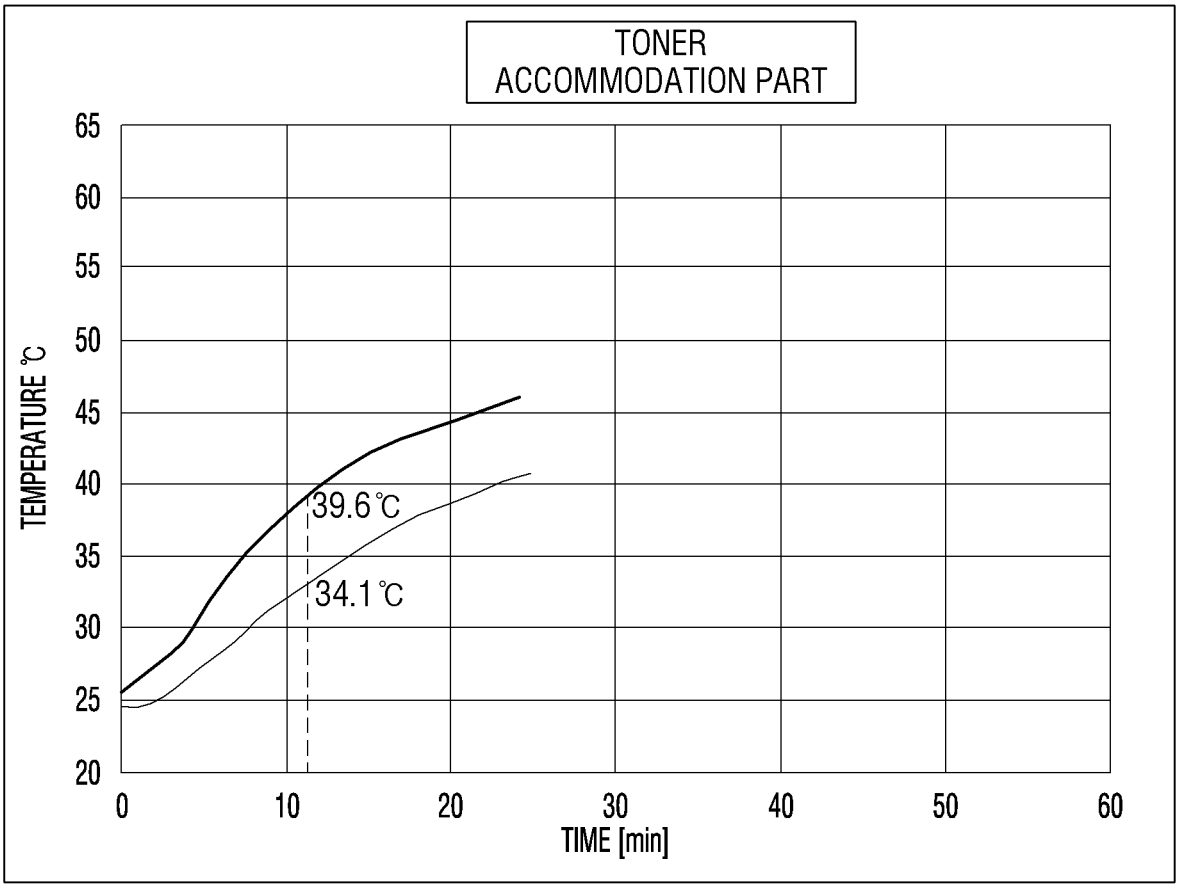
FIG. 6A is a graph illustrating a temperature measurement result of a toner accommodation part depending on the presence of a heat transfer blocking member according to an example.
Figure 6B:
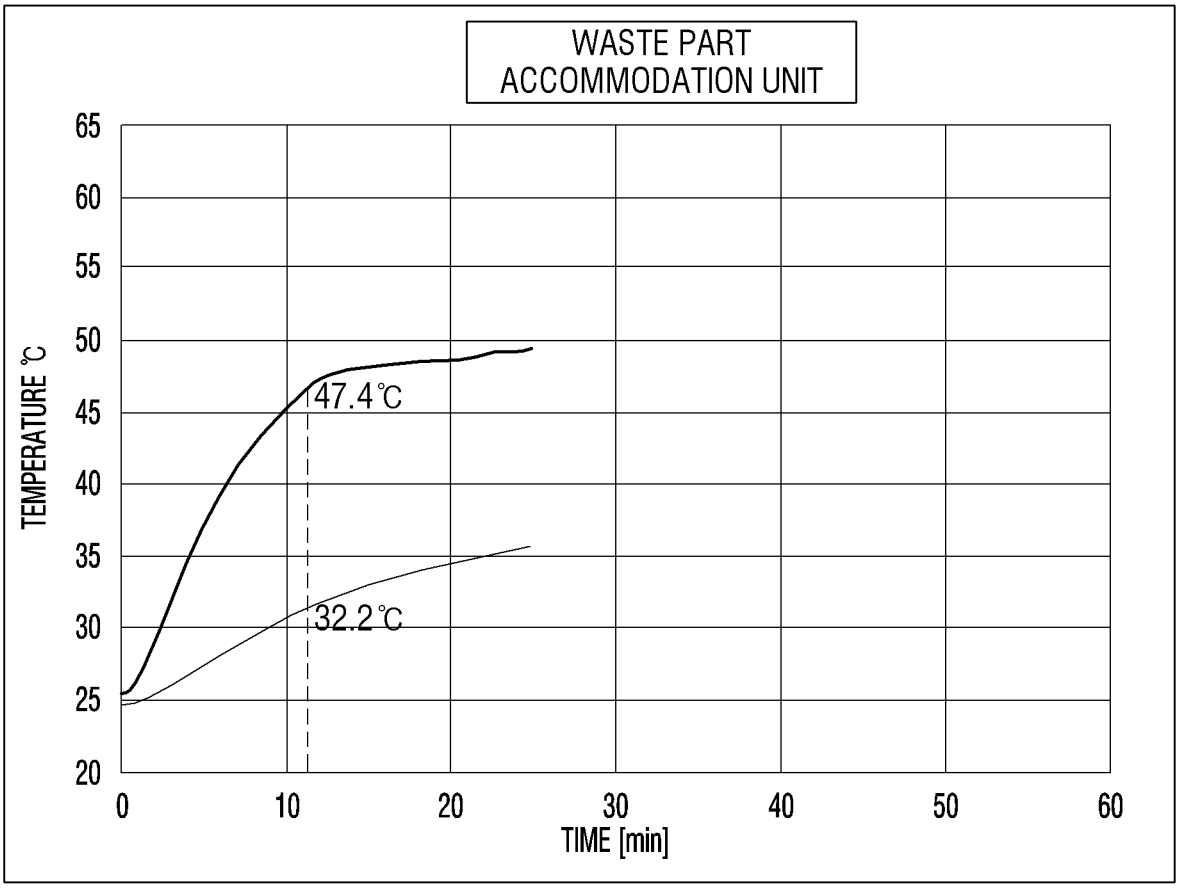
FIG. 6B is a graph illustrating a temperature measurement result of a waste toner accommodation part depending on the presence of a heat transfer blocking member according to an example.

FIG. 6A is a graph illustrating a temperature measurement result of a toner accommodation part according to the presence of a heat transfer blocking member according to an example of the disclosure, and FIG. 6B is a graph illustrating a temperature measurement result of a waste toner accommodation part according to the presence of a heat transfer member according to an example of the disclosure.

FIG. 6A illustrates a graph showing a temperature of a toner accommodation part of a general development cartridge, and a graph showing a temperature of a toner accommodation part 120 of a development cartridge 100 including a heat transfer blocking member 150.

In the case of the general development cartridge 100, the temperature of the toner accommodation part 120 may be measured to be 39.6° C. when print driving is performed for 12 minutes. The temperature of the toner accommodation part 120 of the development cartridge 100 including the heat transfer blocking member 150 according to an example may be measured to be 34.1° C.

Accordingly, the temperature rise may be suppressed in the toner accommodation part 120 of the development cartridge 100 including the heat transfer blocking member 150 than in the toner accommodation part of the general development cartridge.

FIG. 6B illustrates a graph showing the temperature of the waste toner accommodation part of the general development cartridge, and a graph showing the temperature of the waste toner accommodation part 130 of the development cartridge 100 including the heat transfer blocking member 150 according to an example.

In the case of the general development cartridge 100, the temperature of the waste toner accommodation part may be measured to be 47.4° C. when print driving is performed for 12 minutes. The temperature of the waste toner accommodation part 130 of the development cartridge 100 including the heat transfer blocking member 150 according to an example may be measured to be 32.2° C.

Accordingly, the temperature rise may be suppressed in the waste toner accommodation part 130 of the development cartridge 100 including the heat transfer blocking member 150 than in the waste toner accommodation part of the general development cartridge.

Referring to graphs of FIGS. 6A and 6B, as a result of comparison to the general development cartridge, it is seen that the temperature rise is suppressed in the development cartridge 100 including the heat transfer blocking member 150 according to an example than in the general development cartridge 100.

In the development cartridge 100 according to an example, the heat transfer blocking member 150 may be disposed on the outer side of the development cartridge 100, so that heat transferred from the fixing device 40 or the paper discharge tray 60 could be suppressed. Therefore, the solidification of a toner or a waste toner may be prevented due to the temperature rise of the development cartridge 100, and thus the printing quality may be improved.

The space between the development cartridge 100 and the fixing device 40 could be designed to be small as much as the extent of the reduced temperature of the development cartridge 100. Therefore, the miniaturization of the image forming apparatus 1 could be possible.

In addition, the noise generated by the image forming apparatus could be reduced because the image forming apparatus is not cooled by a separated fan. Also, the manufacturing cost of the image forming apparatus 1 could be reduced. In addition, the dust or impurities from the outside may be prevented from flowing into the image forming apparatus 1 because the fan is not provided, and thus it could prevent the inside of the image forming apparatus 1 from being contaminated.

Although examples have been shown and described, it will be appreciated by those skilled in the art that changes may be made to these examples without departing from the principles and spirit of the disclosure. Accordingly, the scope of the disclosure is not construed as being limited to the described examples, but is defined by the appended claims as well as equivalents thereto.

What is claimed is:

1. An image forming apparatus, comprising:

a body;

a development cartridge to be attached to or detached from the body;

a fixing device to fix toner to a recording medium; and a paper discharge tray to load a recording medium discharged from the fixing device, wherein the development cartridge includes:

a first heat blocking plate disposed on an outer side of the development cartridge and adjacent to the fixing device based on the development cartridge being attached to the body; and a second heat blocking plate disposed on the outer side of the development cartridge and in an area corresponding to the paper discharge tray based on the development cartridge being attached to the body.

2. The apparatus as claimed in claim 1, wherein the development cartridge further includes a toner accommodation part to accommodate toner and a waste toner accommodation part, wherein, based on the development cartridge being attached to the body, the toner accommodation part is disposed under the paper discharge tray and the waste toner accommodation part is disposed under the fixing device, wherein the first heat blocking plate is disposed above the waste toner accommodation part, and wherein the second heat blocking plate is disposed above the toner accommodation part.

3. The apparatus as claimed in claim 1, wherein based on the development cartridge is-being attached to the body, a flow path is formed, the flow path to flow from a first location adjacent to an upper portion of the first heat blocking plate to outside the body through a second location adjacently above an upper portion of the second heat blocking plate.

4. The apparatus as claimed in claim 3, wherein each of the first heat blocking plate and the second heat blocking plate includes a plurality of protrusions spaced apart from one another.

5. The apparatus as claimed in claim 4, wherein each of the plurality of protrusions extends in a direction of the flow path.

6. The apparatus as claimed in claim 5, wherein a width of a center portion of the first heat blocking plate is greater than a width of a side portion of the first heat blocking plate.

7. The apparatus as claimed in claim 1, wherein each of the heat blocking plate and the second heat blocking plate has a reflection coefficient of 0.75 or more.

8. The apparatus as claimed in claim 1, wherein each of the first heat blocking plate and the second heat blocking plate has a thermal conductivity coefficient of 200 W/mK or more.

9. A development cartridge to be attached to or detached from a body of an image forming apparatus, the development cartridge comprising:

a housing;

a toner accommodation part to accommodate toner provided inside the housing;

a first heat blocking plate disposed on an outer side of the housing and adjacent to a fixing device in the image forming apparatus based on the development cartridge being attached to the body, the fixing device to fix toner to a recording medium; and a second heat blocking plate disposed on the outer side of the housing and in an area corresponding to a paper discharge tray on which a discharged recording medium passing through the fixing device is loaded based on the development cartridge being attached to the body.

10. The development cartridge as claimed in claim 9, wherein each of the first heat blocking plate and the second heat blocking plate includes a plurality of protrusions spaced apart from one another.

11. The development cartridge as claimed in claim 10, wherein each of the first heat blocking plate and the second heat blocking plate has a reflection coefficient of 0.75 or more and a thermal conductivity coefficient of 200 W/mK or more.

12. The development cartridge as claimed in claim 10, wherein based on the development cartridge being attached to the body, a flow path is formed, the flow path to flow from a first location adjacent to an upper portion of the first heat blocking plate to outside the body through a second location adjacently above an upper portion of the second heat blocking plate.

13. The development cartridge as claimed in claim 12, wherein each of the plurality of protrusions extends in a direction of the flow path.

14. The development cartridge as claimed in claim 9, wherein the development cartridge further includes a waste toner accommodation part, wherein, based on the development cartridge being attached to the body, the toner accommodation part is disposed under the paper discharge tray and the waste toner accommodation part is disposed under the fixing device, wherein the first heat blocking plate is disposed above the waste toner accommodation part, and wherein the second heat blocking plate is disposed above the toner accommodation part.

15. The development cartridge as claimed in claim 9, wherein a width of a center portion of the first heat blocking plate is greater than a width of a side portion of the first heat blocking plate.

* * * * *